US010741164B1

(12) United States Patent
Honda et al.

(10) Patent No.: US 10,741,164 B1
(45) Date of Patent: Aug. 11, 2020

(54) MULTIPURPOSE MICROPHONE IN ACOUSTIC DEVICES

(71) Applicant: Bose Corporation, Framingham, MA (US)

(72) Inventors: Masanori Honda, Northborough, MA (US); Christopher A. Barnes, Lynnfield, MA (US); Ricardo F. Carreras, Southborough, MA (US); Alaganandan Ganeshkumar, North Attleboro, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/424,063

(22) Filed: May 28, 2019

(51) Int. Cl.

| | |
|---|---|
| ***G10K 11/178*** | (2006.01) |
| ***H04R 3/00*** | (2006.01) |
| ***G10L 25/21*** | (2013.01) |
| ***H04R 1/10*** | (2006.01) |
| ***G10L 25/78*** | (2013.01) |

(52) U.S. Cl.
CPC .. *G10K 11/17837* (2018.01); *G10K 11/17853* (2018.01); *G10K 11/17885* (2018.01); *G10L 25/21* (2013.01); *G10L 25/78* (2013.01); *H04R 1/1041* (2013.01); *H04R 1/1083* (2013.01); *H04R 3/005* (2013.01)

(58) Field of Classification Search
CPC ..... G10K 11/17837; G10K 11/17853; G10K 11/17873; G10K 11/17823; G10K 11/1788; G10K 11/178; G10K 2210/3027; G10K 2210/3028; G10K 2210/1081; G10L 25/21; G10L 25/78; H04R 1/1041; H04R 1/1083; H04R 1/406; H04R 3/005; H04R 5/033
USPC ..... 381/71.1, 71.6
See application file for complete search history.

(56) References Cited

U.S. PATENT DOCUMENTS

| | | | | |
|---|---|---|---|---|
| 8,073,150 | B2 | 12/2011 | Joho et al. | |
| 8,073,151 | B2 | 12/2011 | Joho et al. | |
| 8,472,636 | B2 | 6/2013 | Sibbald | |
| 8,620,388 | B2 * | 12/2013 | Hayakawa | G10L 21/0208 370/310.2 |
| 10,034,092 | B1 * | 7/2018 | Nawfal | H04R 5/027 |

(Continued)

OTHER PUBLICATIONS

U.S. Appl. No. 15/463,259, filed Mar. 20, 2017, Yeo et al.

*Primary Examiner* — Ahmad F. Matar
*Assistant Examiner* — Sabrina Diaz
(74) *Attorney, Agent, or Firm* — Fish & Richardson P.C.

(57) ABSTRACT

This document describes a method that includes receiving an input signal representing audio captured by a sensor disposed in an active noise reduction (ANR) device, determining, by one or more processing devices, that the ANR device is operating in a first operational mode, and in response, applying a first gain to the input signal to generate a first amplified input signal. The method also includes determining, by the one or more processing devices, that the ANR device is operating in a second operational mode different from the first operational mode, and in response, applying a second gain to the input signal to generate a second amplified input signal, wherein the second gain is different from the first gain. The method further includes processing the first or second amplified input signal to generate an output signal, and generating, by an acoustic transducer, an audio output based on the output signal.

22 Claims, 7 Drawing Sheets

(56) References Cited

U.S. PATENT DOCUMENTS

| | | | | |
|---|---|---|---|---|
| 10,074,355 | B2 * | 9/2018 | Goldman | G10K 11/1785 |
| 10,096,313 | B1 | 10/2018 | terMeulen et al. | |
| 2006/0153394 | A1 * | 7/2006 | Beasley | H03G 3/344 381/57 |
| 2011/0206217 | A1 * | 8/2011 | Weis | H04R 1/1041 381/74 |
| 2011/0293103 | A1 * | 12/2011 | Park | G10L 21/0208 381/57 |
| 2014/0213329 | A1 * | 7/2014 | Wu | H04M 1/6058 455/570 |
| 2018/0167715 | A1 * | 6/2018 | Graylin | G10K 11/17827 |

* cited by examiner

MULTIPURPOSE MICROPHONE IN ACOUSTIC DEVICES

TECHNICAL FIELD

This description generally relates to acoustic devices including a multipurpose microphone.

BACKGROUND

Acoustic devices are used in numerous environments and for various purposes, including entertainment purposes, such as listening to music, productive purposes, such as phone calls, and professional purposes, such as aviation communications or sound studio monitoring. Different purposes may require an acoustic device to detect sounds within the environment, such as by using a microphone. For example, to allow for voice communications or voice recognition, an acoustic device can use a microphone to detect a user's voice within the environment. Other acoustic devices can include noise reduction or noise cancellation features that counteract ambient noise detected in the environment.

SUMMARY

In one aspect, this document features a method that includes receiving an input signal representing audio captured by a sensor disposed in an active noise reduction (ANR) device, determining, by one or more processing devices, that the ANR device is operating in a first operational mode, and in response, applying a first gain to the input signal to generate a first amplified input signal. The method also includes determining, by the one or more processing devices, that the ANR device is operating in a second operational mode different from the first operational mode, and in response, applying a second gain to the input signal to generate a second amplified input signal, wherein the second gain is different from the first gain. The method further includes processing the first or second amplified input signal to generate an output signal, and generating, by an acoustic transducer, an audio output based on the output signal.

In another aspect, this document features an automatic noise reduction (ANR) device that includes one or more sensors for capturing audio, at least one amplifier that amplifies an input signal representative of the audio captured by the one or more sensors, and a controller that includes one or more processing devices. The controller is configured to determine that the ANR device is operating in a first operational mode, and in response, apply a first gain to the input signal to generate a first amplified input signal. The controller is further configured to determine that the ANR device is operating in a second operational mode different from the first operational mode, and in response, apply a second gain, different from the first gain, to the input signal to generate a second amplified input signal, and process the first or second amplified input signal to generate an output signal. The ANR device also includes an acoustic transducer for generating an audio output based on the output signal.

In yet another aspect, this document features one or more non-transitory machine-readable storage devices storing machine-readable instructions that cause one or more processing devices to execute various operations. The operations include receiving an input signal representing audio captured by a sensor disposed in an active noise reduction (ANR) device, determining that the ANR device is operating in a first operational mode, and in response, applying a first gain to the input signal to generate a first amplified input signal. The operations also include determining that the ANR device is operating in a second operational mode different from the first operational mode, and in response, applying a second gain, different from the first gain, to the input signal to generate a second amplified input signal. The operations also include processing the first or second amplified input signal to generate an output signal, and causing an acoustic transducer to generate an audio output based on the output signal.

Implementations of the above aspects can include one or more of the following features.

The first operational mode of the ANR device can include a voice communications mode, and the second operational mode of the ANR device can include a noise reduction mode. The sensor can include a microphone of the ANR device. The output signal can include a drive signal for the acoustic transducer. The first or second amplified input signal can be processed using at least one compensator to generate the drive signal for the acoustic transducer. The drive signal can include an anti-noise signal. A second input signal representing audio captured by a second sensor disposed in the ANR device can be received, and the second input signal can be combined with the first or second amplified input signal to produce a combined input signal. The combined input signal can be processed using at least one compensator to generate the output signal for the ANR device. The output signal can include an anti-noise signal. A second input signal representing audio captured by a second sensor disposed in the ANR device can be received, and the second input signal can be processed with the first or second amplified input signal to steer a beam toward the mouth of a user of the ANR device to generate a primary signal. Also, the corresponding amplified input signal and the second input signal can be processed to steer a null toward the mouth of the user of the ANR device to generate a reference signal, and the primary signal can be processed using the reference signal as a noise reference to generate the output signal for the ANR device. The beam or null can be steered using one of: a near field beamforming technique or a delay-and-sum beamforming technique.

These and other aspects, features, and implementations can be expressed as methods, apparatus, systems, components, program products, methods of doing business, means or steps for performing a function, and in other ways, and will become apparent from the following descriptions, including the claims.

DESCRIPTION OF DRAWINGS

Like reference symbols in the various drawings indicate like elements.

DETAILED DESCRIPTION

Figure 1:
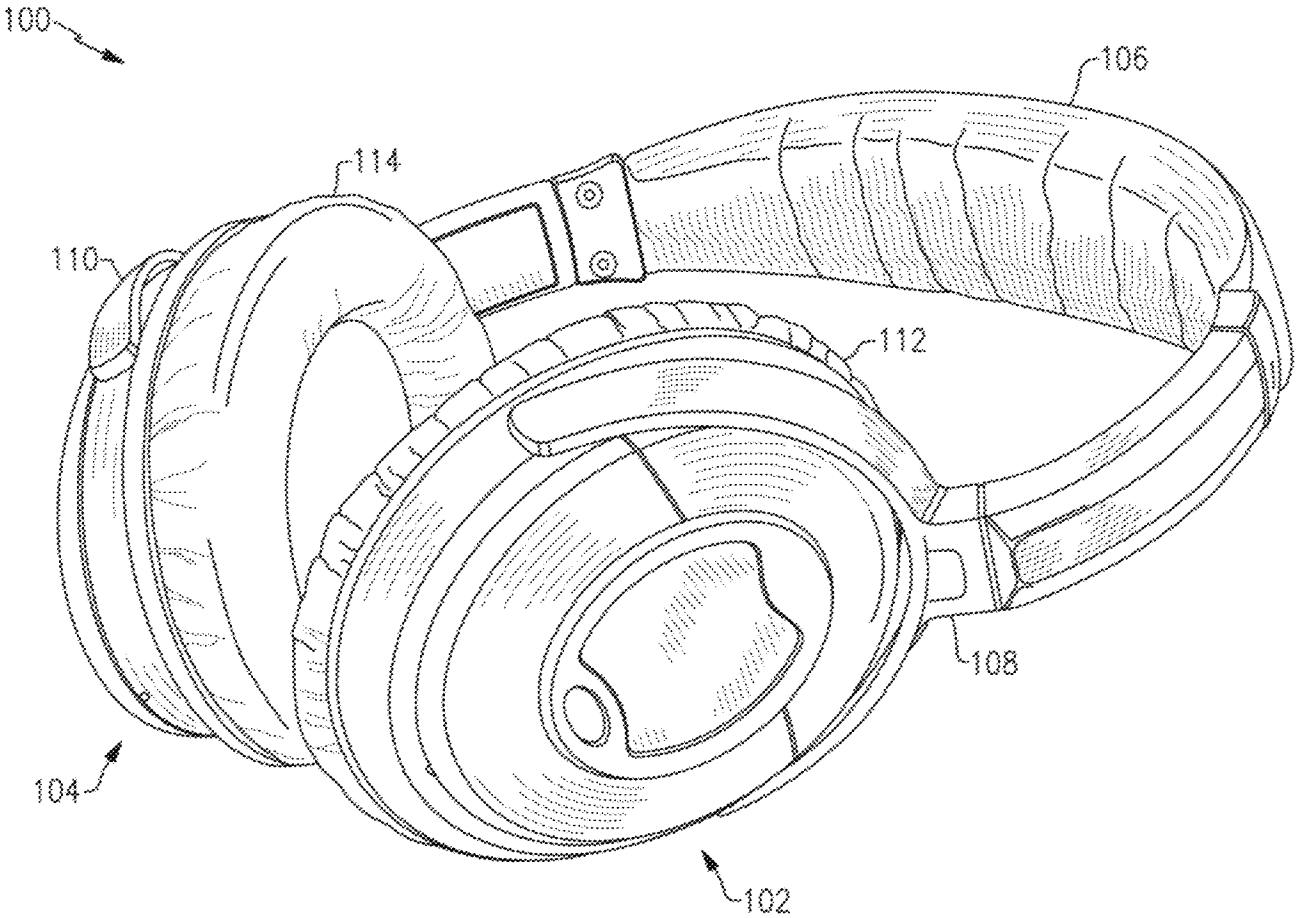
FIG. 1 is a perspective view of an example headphones set.

Acoustic devices, such as headphones, headsets, or other acoustic systems, can include various features that involve the detection of sounds within the surrounding environment. Typically, these sounds are detected using one or more microphones included in the acoustic device. The acoustic signals produced by the microphones are processed by the acoustic device to implement the various features. For example, in some cases, the acoustic device can process the acoustic signals to isolate and detect a user's voice in order to implement voice communications or voice recognition features. In some cases, the acoustic device can process the acoustic signals to generate an anti-noise signal to implement active noise reduction (ANR) features. The features included in an acoustic device can have different signal-level requirements for the acoustic signals detected by the microphones.

Aspects of the present disclosure are directed to acoustic devices having one or more multipurpose microphones. Each multipurpose microphone can produce acoustic signals that can be processed to implement two or more features of the acoustic device, such as communication features and ANR features, among others. In some cases, the acoustic device can determine an operational mode of the device (or of a connected device, such as a mobile phone), and can adjust the gain or another parameter applied to the acoustic signals based on the operational mode. In this way, the acoustic device can optimize the processing of the acoustic signals in accordance with the signal requirements of individual features while reducing the cost, power consumption, and space requirements of the acoustic device when compared to an acoustic device using separate microphones for each feature.

We use the term "multipurpose microphone" broadly to include any analog microphone, digital microphone, or other acoustic sensor included in an acoustic device and configured to produce acoustic signals used to implement two or more features of the acoustic device including, but not limited to, communication features and ANR features. In contrast, we sometimes use the terms "single purpose microphone" or "dedicated microphone" to refer to a microphone configured to produce acoustic signals used to implement a particular feature of the acoustic device.

The technology described here can include or operate in headsets, headphones, hearing aids, or other personal acoustic devices, as well as acoustic systems such as those that can be applied to home, office, or automotive environments. Throughout this disclosure the terms "headset," "headphone," "earphone," and "headphone set" are used interchangeably, and no distinction is meant to be made by the use of one term over another unless the context clearly indicates otherwise. Additionally, aspects and examples in accord with those disclosed here are applicable to various form factors, such as in-ear transducers or earbuds, on-ear or over-ear headphones, or audio devices that are worn near an ear (including open-ear audio devices worn on the head or shoulders of a user) and that radiates acoustic energy into or towards the ear, and others.

Examples disclosed here can be coupled to, or placed in connection with, other systems, through wired or wireless means, or can be independent of any other systems or equipment. Examples disclosed can be combined with other examples in any manner consistent with at least one of the principles disclosed here, and references to "an example," "some examples," "an alternate example," "various examples," "one example" or the like are not necessarily mutually exclusive and are intended to indicate that a particular feature, structure, or characteristic described can be included in at least one example. The appearances of such terms here are not necessarily all referring to the same example.

FIG. 1 illustrates a set of headphones 100 having two earpieces, i.e., a right earcup 102 and a left earcup 104, coupled to a right yoke assembly 108 and a left yoke assembly 110, respectively, and intercoupled by a headband 106. The right earcup 102 and left earcup 104 include a right circumaural cushion 112 and a left circumaural cushion 114, respectively. Although the example headphones 100 are shown with earpieces having circumaural cushions to fit around or over the ear of a user, in other examples the cushions can sit on the ear, or can include earbud portions that protrude into a portion of a user's ear canal, or can include alternate physical arrangements. As discussed in more detail below, either or both of the earcups 102, 104 can include one or more microphones, some or all of which can be multipurpose microphones. Although the example headphones 100 illustrated in FIG. 1 include two earpieces, some examples can include only a single earpiece for use on one side of the head only. Additionally, although the headphones 100 illustrated in FIG. 1 include a headband 106, other examples can include different support structures to maintain one or more earpieces (e.g., earcups, in-ear structures, etc.) in proximity to a user's ear, e.g., an earbud can include a shape and/or materials configured to hold the earbud within or near a portion of a user's ear.

Figure 2:
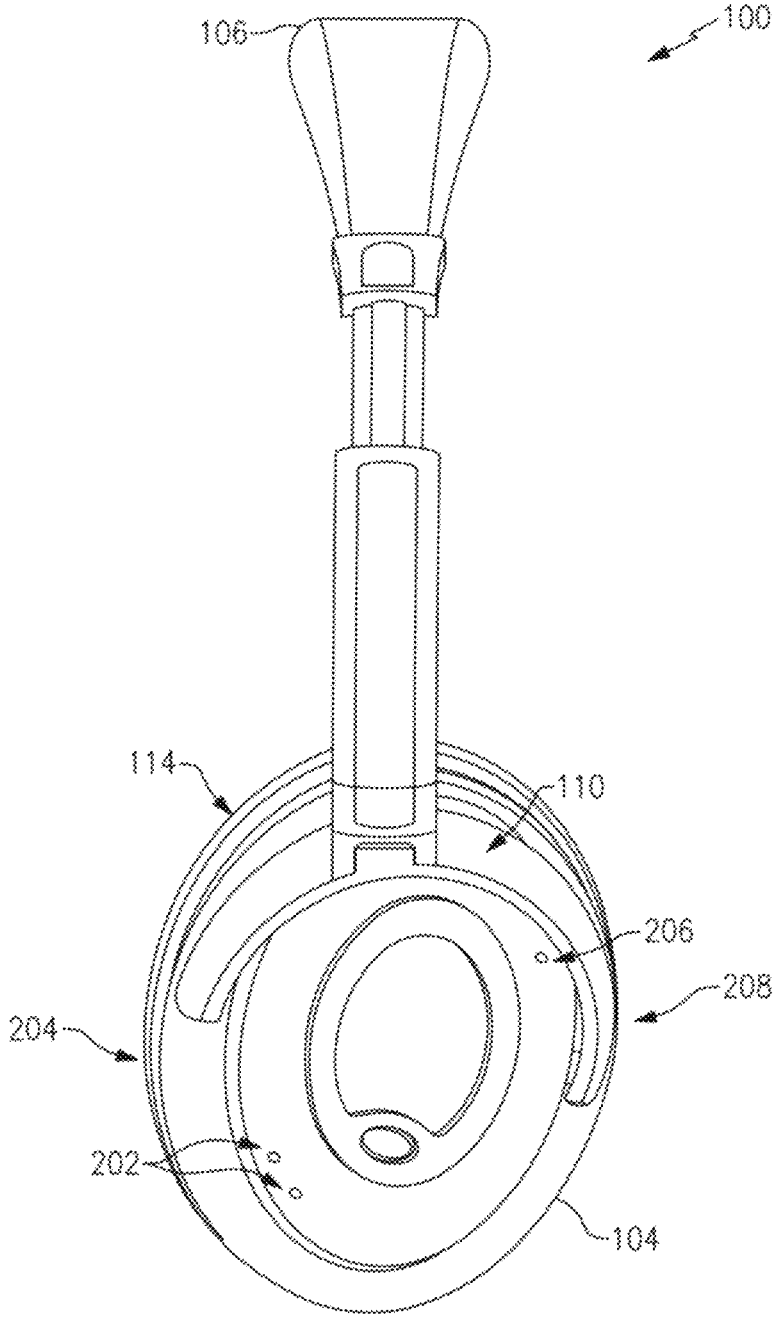
FIG. 2 is a left-side view of an example headphones set.

FIG. 2 illustrates the headphones 100 from the left side and shows details of the left earcup 104 including a pair of front microphones 202, which can be near a front edge 204 of the earcup, and a rear microphone 206, which can be near a rear edge 208 of the earcup. The right earcup 102 can additionally or alternatively have a similar arrangement of front and rear microphones, though in examples the two earcups can have a differing arrangement in number or placement of microphones. Some or all of the front microphones 202 or the rear microphones 206, or both, can be multipurpose microphones used to implement two or more features of the headphones 100. In some cases, one of the front microphones 202 can be a multipurpose microphone, and each of the remaining microphones 202, 206 can be dedicated to a particular feature of the headphones 100.

In various examples, the headphones 100 can have more, fewer, or no front microphones 202 and can have more, fewer, or no rear microphones 206, so long as the headphones include at least one multipurpose microphone. In some cases, the headphones 100 can include one or more multipurpose or dedicated microphones internal to the right earcup 102 or the left earcup 104, or both. Although microphones are illustrated in the various figures and labeled with reference numerals, such as reference numerals 202, 206 the visual element illustrated in the figures can, in some examples, represent an acoustic port wherein acoustic signals enter to ultimately reach a microphone 202, 206 which can be internal and not physically visible from the exterior. In examples, one or more of the microphones 202, 206 can be immediately adjacent to the interior of an acoustic port, or can be removed from an acoustic port by a distance, and can include an acoustic waveguide between an acoustic port and an associated microphone.

Figure 3:
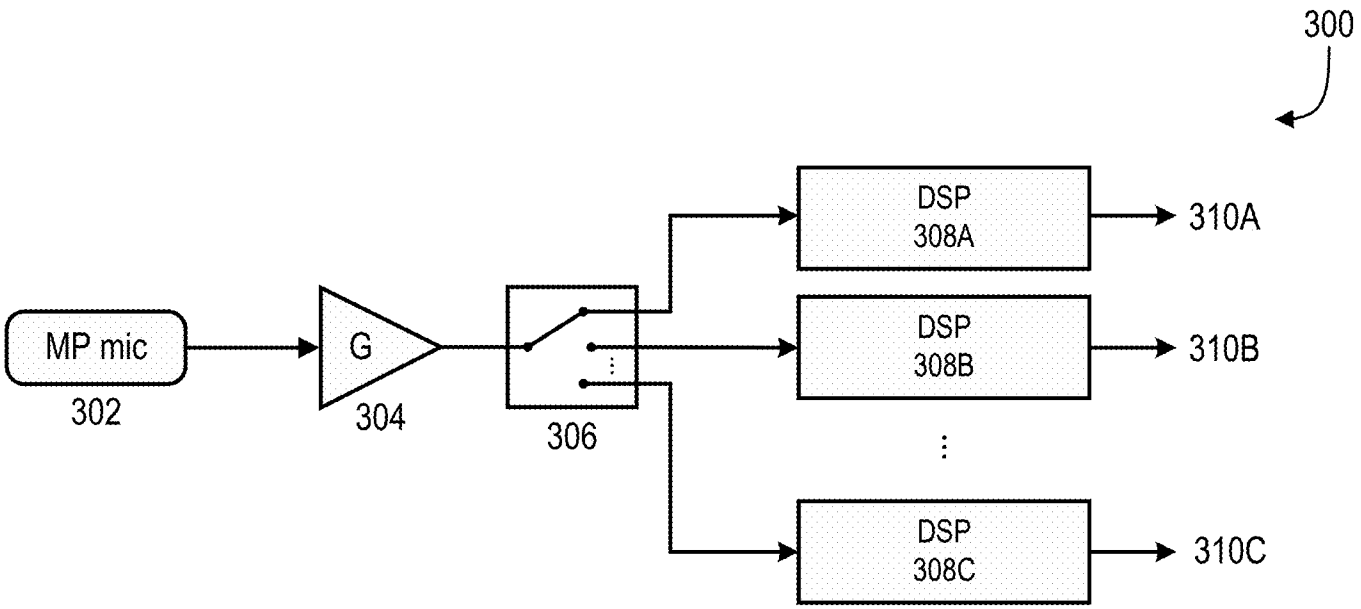
FIGS. 3 and 4 are block diagrams of example systems for processing signals received from a multipurpose microphone.

FIG. 3 illustrates an example signal processing system 300 for processing signals received from a multipurpose microphone 302. The multipurpose microphone 302 can be an analog microphone, a digital microphone, or another acoustic sensor configured to produce acoustic signals representative of sounds in the environment surrounding the acoustic device. For example, the multipurpose microphone 302 can be one of the front microphones 202 of the headphones 100. For clarity, system 300 is depicted with a single multipurpose microphone 302. However, in some cases, the system 300 can include two or more multipurpose microphones or at least one multipurpose microphone and one or more dedicated microphones. For example, system 300 can include two or more multipurpose microphones operating in combination with multipurpose microphone 302. Furthermore, in some examples, a system such as the headphones 100 may include two or more signal processing systems 300, each configured to process signals received from one or more multipurpose microphones.

As shown in FIG. 3, the multipurpose microphone 302 can be coupled with an amplifier 304. The amplifier 304 can apply a gain, G, to the signals produced by the multipurpose microphone 302. For example, the gain applied by the amplifier 304 can be an analog gain and the amplifier 304 can be a variable gain amplifier (VGA).

The output of the amplifier 304 can be coupled to a switch 306 configured to selectively couple the amplifier output to one or more digital signal processors (DSPs) 308A-308C (collectively referred to as 308). The switch 306 can be implemented as a hardware switch, a software switch, a combination of both hardware and software components, etc. In some cases, the DSPs 308 that are selectively coupled to the amplifier output by the switch 306 are selected based on input from a user. In some cases, the DSPs 308 that are selectively coupled to the amplifier output by the switch 306 are selected automatically by the acoustic device. For example, selecting the one or more DSPs 308 can be based on time, location of the acoustic device, one or more characteristics of the amplifier output, etc.

In some cases, the signal processing system 300 can include one or more analog-to-digital converters (ADC) either before or after the switch 306 to convert an analog output of the amplifier 304 to a digital input for the DSPs 308. In cases where the amplifier 304 applies a digital gain to the signals produced by the multipurpose microphone 302, an ADC can be included before the amplifier 304.

The DSPs 308 process the signals produced by the multipurpose microphone 302 to produce corresponding outputs 310A-310C (collectively referred to as 310). For example, the signals can be processed to implement one or more features of the acoustic device. In some cases, each of the DSPs 308 can be associated with different features of the acoustic device. For example, DSP 308A may implement an ANR feature of the acoustic device while DSP 308B may implement a communication feature of the acoustic device. In some cases, some or all of the DSPs 308 can be combined such that a single DSP implements two or more of the features of the acoustic device. Examples of such DSPs are described in U.S. Pat. Nos. 8,073,150 and 8,073,151, which are incorporated herein by reference in their entirety.

The features of the acoustic device implemented by the DSPs 308 can include a variety of features such as ANR features, voice communication features, a "talk-through" or a "hear-through" feature, etc. Further description of these features is provided below.

In some cases, an acoustic device containing signal processing system 300 can be an ANR system, wherein one or more of the DSPs 308 implement an ANR feature. In general, an ANR system can include an electroacoustic or electromechanical system that is configured to cancel at least some of the unwanted noise (often referred to as "primary noise") based on the principle of superposition. For example, the ANR system can identify an amplitude and phase of the primary noise and produce another signal (often referred to as an "anti-noise signal") of approximately equal amplitude and opposite phase. The anti-noise signal can then be combined with the primary noise such that both are substantially canceled at a desired location. The term substantially canceled, as used herein, may include reducing the "canceled" noise to a specified level or to within an acceptable tolerance, and does not require complete cancellation of all noise. Thus, one or more DSPs 308 of the signal processing device 300 may implement an ANR feature of the acoustic device by processing the primary noise signal (e.g. the signal produced by the multipurpose microphone 302) to produce an anti-noise signal (e.g. one or more outputs 310) for the purpose of noise cancellation. An ANR feature, as described here, can be used in attenuating a wide range of noise signals, including, for example, broadband noise and/or low-frequency noise that may not be easily attenuated using passive noise control systems.

In some cases, an acoustic device containing signal processing system 300 can implement one or more communication features. In particular, a communication feature may in some cases be a voice communication feature. A voice communication feature can generate a voice signal representative of the voice of a user of the acoustic device or of another user. The voice signal can be used locally by the acoustic device or passed to another device, such as a mobile device, etc., coupled to the acoustic device. The voice signal can be used for voice communications, such as in a phone call, or for voice recognition, such as for speech-to-text or communication with a virtual personal assistant, among others. In some cases, the communication feature may generate a signal representative of sounds other than voices (e.g. music), which may also be used locally or passed to another device for communications, such as in a phone call. Thus, one or more DSPs 308 of the signal processing device 300 may implement a communication feature of the acoustic device by processing the signal produced by the multipurpose microphone 302 to generate a voice signal or other signal (e.g. one or more outputs 310) for voice recognition, call purposes, etc. In some cases, implementing a communication feature may also include a beamforming process, using signals captured by one or more additional multipurpose or dedicated microphones. Beamforming processes are described in further detail below in relation to FIG. 5.

In some cases, an acoustic device containing signal processing system 300 can implement a feature that may be referred to as a "talk-through" or "hear-through" mode. Again, the acoustic device may be an ANR system; however, in such a mode, at least a portion of the signal captured by the multipurpose microphone 302 is not cancelled. In this mode, a microphone (e.g., multipurpose microphone 302) can be used to detect external sounds that the user might want to hear, and the acoustic device can be configured to generate a signal (e.g., one or more outputs 310) that passes such sounds through to be reproduced to the user by a transducer. In some implementations, signals captured by multiple sensors (e.g., one or more additional multipurpose or dedicated microphones) can be used (e.g., using a beamforming process) to focus, for example, on the user's voice or another source of ambient sound. In some implementations, the acoustic device can allow for multi-mode operations including a hear-through mode in which the ANR functionality may be switched off or at least reduced, over at least a range of frequencies, to allow relatively wide-band ambient sounds to reach the user. In some implementations, the acoustic device can also be used to shape a frequency response of the signals passing through the headphones. For instance, one or more of the DSPs 308 of the signal processing system 300 may be used to change an acoustic experience of having an earbud blocking the ear canal to one where ambient sounds (e.g., the user's own voice) sound more natural to the user.

Each of the features of the acoustic device described above (e.g., ANR features, communication features, "talk through" or "hear through" features, etc.) may have different signal level requirements. For example, implementing a communication feature of an acoustic device may require a higher signal-to-noise ratio (SNR) than is required to implement an ANR feature of the acoustic device. In general, applying a gain to an acoustic signal increases SNR; however, as the gain increases, the likelihood of clipping the acoustic signal increases as well. We use the term "clipping" broadly to describe waveform distortions that occur when an amplifier is overdriven. For example, when an amplifier attempts to deliver a voltage or current above its maximum capability (e.g. to apply a high gain value), clipping of the acoustic signal may occur. Consequently, the different signal level requirements of various features of the acoustic device can be related to a level of perceived objection to clipping in the implementation of each feature. As an example, a user may perceive clipping to be more objectionable in the implementation of an ANR feature than in the implementation of a communication feature of the acoustic device. This may be the case because clipping the acoustic signal while implementing the ANR feature can produce acoustic artifacts (e.g. loud noises, squeals, etc.) that are uncomfortable or otherwise undesired by the user.

To accommodate for the different signal requirements for different features, the system 300 can determine an operational mode of the acoustic device (or a connected device) and can adjust the gain applied by the amplifier (or another parameter). For example, when implementing a communication feature of the acoustic device in which clipping is less objectionable, a higher gain may be applied to the acoustic signal in order to increase SNR. In contrast, when implementing an ANR feature of the acoustic device in which clipping is more objectionable, a lower gain may be applied to the acoustic signal to achieve a high SNR while ensuring that clipping does not occur too frequently during everyday use cases of the acoustic device.

In some cases, two separate DSPs may be used to implement the ANR feature and the communication feature respectively. For example, referring again to FIG. 3, DSP 308A can implement an ANR feature of the acoustic device while DSP 308B can implement a communications feature of the acoustic device. In this example, the gain, G, applied by the amplifier 304, can be modified depending on an operating mode of the acoustic device. For example, in scenarios where the switch 306 selectively couples the amplifier output to DSP 308A to operate the acoustic device in an ANR mode, the gain G may be set to a value suitable for the ANR feature, increasing SNR while limiting occurrences of objectionable clipping. However, in scenarios where the switch 306 selectively couples the amplifier output to DSP 308B to operate the acoustic device in a communication mode, the gain G may be set to a higher value suitable for the communication feature, further increasing SNR.

In another example, DSP 308A can again implement an ANR feature of the acoustic device while DSP 308B can implement a communications feature of the acoustic device. However, in this example, the gain, G, can be fixed at a value suitable for the ANR feature, increasing SNR while limiting occurrences of objectionable clipping. Thus, in scenarios where the switch 306 selectively couples the amplifier output to DSP 308A to operate the acoustic device in an ANR mode, clipping is sufficiently avoided. However, in scenarios where the switch selectively couples the amplifier output to DSP 308B to operate the acoustic device in a communication mode, DSP 308B can apply an additional gain (e.g., a digital gain) to further increase SNR for communication operations.

As demonstrated in the above examples, operation of the switch 306 and/or adjustment of the gain G applied by the amplifier 304 can correspond to a determination of an operating mode of the acoustic device or connected device. In some cases, determining the operating mode of the acoustic device can be based on one or more direct inputs from a user. In some cases, the operating mode of the acoustic device can be determined automatically based on time, location of the acoustic device, one or more characteristics of the amplifier output, analysis of the acoustic signals received from the microphone etc. For example, if a connected device is running a video conferencing application or making a phone call, the acoustic device may automatically operate in a communication mode. In another example, if the acoustic device receives location data indicative of the user riding a bus, the acoustic device may automatically operate in an ANR mode. In yet another example, if analysis of the acoustic signals received from the multipurpose microphone 302 indicates the presence of both human voices and loud engine noise, the acoustic device may automatically operate in a "talk-through" mode, cancelling the engine noise while passing through the human voices to the user.

The described approaches for processing signals received from a multipurpose microphone may provide the following advantages. By using a single microphone in the implementation of multiple features of an acoustic device, component count is reduced while maintaining an optimal gain level for each feature of the device. This can decrease both cost and size of the acoustic device. It can also allow for the inclusion of additional microphones on the acoustic device that can improve performance (e.g., feedforward ANR performance). The approaches described here can also improve the stability of ANR devices.

Figure 4:
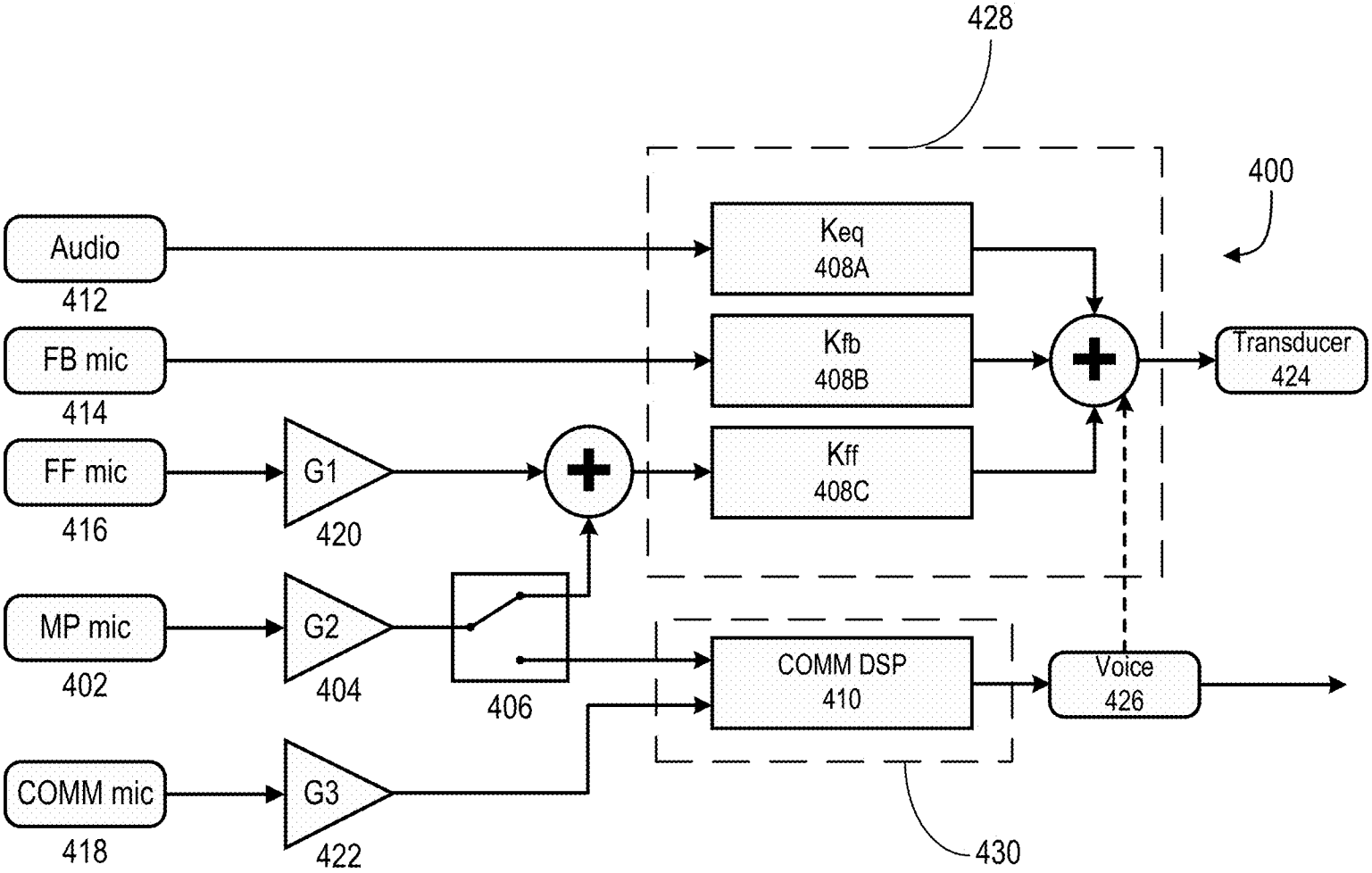

FIG. 4 illustrates an example signal processing system 400 for processing signals received from a multipurpose microphone to implement ANR and communication features. As in signal processing system 300, signal processing system 400 includes a multipurpose microphone 402 coupled with an amplifier 404. The amplifier 404 can apply a gain, G2, to the signals produced by the multipurpose microphone 402. For example, the gain applied by the amplifier 404 can be an analog gain and the amplifier 404 can be a variable gain amplifier (VGA). The output of the amplifier 404 is coupled to a switch 406 configured to selectively couple the amplifier output to one or more digital signal processors (DSPs) depending on an operating mode of the acoustic device or connected device. In particular, switch 406 is configured to selectively couple the amplifier output to a feedforward compensator 408C to implement an ANR feature of the device or to selectively couple the amplifier output to a communications DSP 410 to implement a communication feature of the device. The signal processing system 400, as shown, is currently configured to operate in an ANR mode of the device.

In signal processing system 400, the signals received from the multipurpose microphone 402 are combined with signals from additional microphones and devices to implement the ANR and communication features of the acoustic device. While FIG. 4 is a particular implementation of signal processing system 400, in some cases, one or more other multipurpose microphones or dedicated microphones, or both, may be included to implement features of the acoustic device.

To implement an ANR feature, system 400 includes signals from a dedicated feedback microphone 414 and a dedicated feedforward microphone 416 in addition to the signal from the multipurpose microphone 402. Signal processing system 400 can also include an audio signal 412 from the acoustic device or a connected device (e.g., an audio playback signal from a phone), which is intended to be presented to the user. The audio signal is processed by an equalization compensator $K_{eq}$ 408A, the signal from the feedback microphone 414 is processed by a feedback compensator $K_{fb}$ 408B, and the signal from the feedforward microphone 416 is processed by a feedforward compensator $K_{ff}$ 408C. In some cases, the feedforward compensator $K_{ff}$ 408C can also include a parallel pass-through filter to allow for hear-through such as described in U.S. Pat. No. 10,096,313 which is incorporated herein by reference in its entirety. The outputs of the compensators (collectively referred to as 408) are then combined to generate an anti-noise signal, which is delivered to be output by a transducer 424.

In some cases, prior to processing by the compensators 408, one or more of the audio signal 412, the signal from the feedback microphone 414, and the signal from the feedforward microphone 416 may be amplified. For example, amplifier 420 may apply a gain G1 to the signal from the feedforward microphone 416 prior to being processed by feedforward compensator 408C.

In some cases, one or more of the audio signal 412, the signal from the feedback microphone 414, and the signal from the feedforward microphone 416 may be converted to a digital signal prior to being processed by the compensators 408. For example, signal processing system 400 may include one or more ADCs disposed before the compensators 408. Moreover, in some cases, a digital-to-analog converter (DAC), may be included before the transducer 424 to convert the digital output of the compensators 408 to an analog signal.

In some cases, the compensators 408 may be implemented using separate DSPs or may be implemented on a single DSP. In some cases, the one or more DSPs that implement the compensators 408 may be included on a single processing chip 428, which may further include ADCs and/or DACs.

In scenarios where the amplified output of the multipurpose microphone 402 is selectively coupled to feedforward compensator 408C (e.g., in an ANR operating mode of the acoustic device), the multipurpose microphone can effectively act as an additional feedforward microphone. In such scenarios, the amplified output of the multipurpose microphone 402 can be combined (e.g., summed) with the amplified output of the feedforward microphone 416 prior to being processed by feedforward compensator 408C to generate an anti-noise signal. Using the multipurpose microphone 402 as an additional feedforward microphone can have the benefit of reducing the overall gain required in the feedforward signal path, thus providing more headroom in the ANR system and reducing the chance of instability. The term headroom, as used herein, includes the difference between the signal-handling capabilities of an electrical component, such as the compensators 408 and the transducer 424, and the maximum level of the signal in the signal path, such as the feedforward or feedback signal path. The reduced signal path gain may also allow the ANR system to better tolerate non-ideal microphone locations, such as microphone locations that are closer to the periphery of an ear-cup of the acoustic device where the chances of coupling between the microphone and the transducer may be high.

To implement a communication feature, system 400 includes a signal from a dedicated communications microphone 418 in addition to the signal from the multipurpose microphone 402. The communications microphone 418 is coupled to an amplifier 422. The amplifier 422 can apply a gain, G3, to the signals produced by the communications microphone 418. The amplified output is then delivered for processing by a communications DSP 410 that outputs a voice signal 426. In some cases, the voice signal 426 is sent to the processing chip 428 and summed with the output from the compensators 408 for output at the transducer 424 (e.g., a loudspeaker). In some cases, the voice signal 426 may be sent to one or more other devices for further processing or for outputting by one or more other transducers.

In some cases, the signal from the communications microphone 418 may be converted to a digital signal prior to being processed by the communications DSP 410. For example, signal processing system 400 may include one or more ADCs disposed before the communications DSP 410. Moreover, in some cases, a digital-to-analog converter (DAC), may be included after the communications DSP 410 to convert the digital output of the communications DSP 410 to an analog voice signal 426. In some cases, the communications DSP 410, ADCs, and/or DACs may be included on a processing chip 430.

In scenarios where the amplified output of the multipurpose microphone 402 is selectively coupled to communications DSP 410 (e.g., in a communications operating mode of the acoustic device), the multipurpose microphone can effectively act as an additional communications microphone. In such scenarios, the amplified output of the multipurpose microphone 402 can be delivered to the communications DSP 410 for joint processing with the signal from the dedicated communications microphone 418. For example, a beamforming process may be implemented by communications DSP 410 to optimize pick-up of a user's voice. Beamforming is described in further detail with relation to FIG. 5 below.

In some cases, the gains G1, G2, and G3 applied by amplifiers 420, 404, and 420 respectively may be different from one another. In some cases, they may be the same. In some cases the gains G1, G2, and G3 may be fixed, and in some cases, one or more of the gains G1, G2, and G3 may be variable (e.g., adjusted using a variable gain amplifier).

In one example, the signal processing system 400 applies a similar gain to the signals from each of the feedforward microphone 416, the multipurpose microphone 402, and the communications microphone 418 (e.g., such that G1 G2 G3). In this example, the similar gain applied by each of the amplifiers 420, 404, and 422 may be an analog gain low enough to be suitable for implementing an ANR feature of the acoustic device (e.g., increasing SNR while preventing frequent clipping). For example, the applied gain may be set to be as high as the ANR system can tolerate without significant clipping occurring too often in the acoustic device during everyday use cases. Thus, in scenarios where the amplified output of the multipurpose microphone 402 is coupled to the feedforward compensator 408C (e.g., in an ANR mode of the acoustic device), objectionable clipping of the acoustic signal is substantially avoided. However, in scenarios where the amplified output of the multipurpose microphone 402 is coupled to the communications DSP 410 (e.g., in a communications mode of the acoustic device), the communications DSP 410 can be configured to provide additional amplification (e.g., by applying a digital gain) to further increase SNR in cases where clipping is not objectionable.

In another example, the signal processing system 400 can apply different gains using amplifiers 420, 404, and 422. In particular, the amplifier 422 coupled to the communications microphone 418 may apply a higher gain G3 than the gain G1 applied by the amplifier 420. This may be the case because clipping of the acoustic signal from the feedforward microphone 416 is more objectionable than clipping of the acoustic signal from the communications microphone 418. In this example, amplifier 404 may be a variable gain amplifier that adjusts the level of applied gain G2 depending on an operating mode of the acoustic device. For example, when the acoustic device is operating in an ANR mode such that multipurpose microphone 402 is acting as an additional feedforward microphone, gain G2 may be set to a value low enough to prevent frequent clipping. However, when the acoustic device is operating in a communications mode such that multipurpose microphone 402 is acting as an additional communications microphone, gain G2 may be increased to a higher value to further increase SNR.

While FIGS. 3 and 4 depict particular example arrangements of components for implementing the technology described herein, other components and/or arrangements of components may be used without deviating from the scope of this disclosure. In some implementations, the arrangement of components along a feedforward path can include an analog microphone, an amplifier (e.g., a VGA), an analog to digital converter (ADC), a digital adder, a feedforward compensator, and another digital adder, in that order. This is similar to the order depicted in the feedforward path of FIG. 4. In some implementations, the arrangement of components along a feedforward path can include an analog microphone, an analog adder (in case of multiple microphones), an ADC, an amplifier (e.g., a VGA), and a feedforward compensator.

Figure 5:
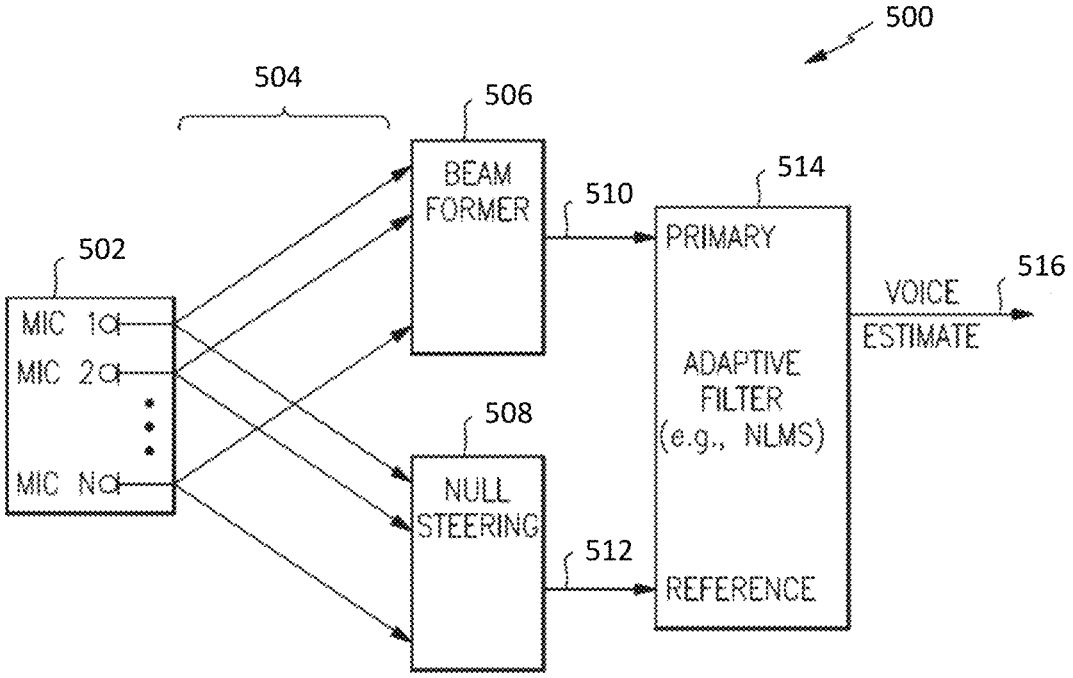
FIG. 5 is a block diagram of an example system for implementing a beamforming process.

As mentioned previously, in some cases, beamforming may be used by signal processing systems 300, 400 to enhance a component of an audio signal with respect to background noise. For example, a beamforming process may be implemented on communications DSP 410 to produce a voice signal 426 that includes a user's voice component enhanced with respect to background noise and other talkers. FIG. 5 is a block diagram of an example signal processing system 500 that implements a beamforming process. A set of multiple microphones 502 convert acoustic energy into electronic signals 504 and provide the signals 504 to each of two array processors 506, 508. For example, the set of microphones 502 may correspond to multipurpose microphone 402 and dedicated communications microphone 418. The signals 504 may be in analog form. Alternately, one or more analog-to-digital converters (ADCs) (not shown) may first convert the microphone outputs so that the signals 504 may be in digital form.

The array processors 506, 508 apply array processing techniques, such as phased array, delay-and-sum techniques, etc. and may utilize minimum variance distortionless response (MVDR) and linear constraint minimum variance (LCMV) techniques, to adapt a responsiveness of the set of microphones 502 to enhance or reject acoustic signals from various directions. Beam forming enhances acoustic signals from a particular direction, or range of directions, while null steering reduces or rejects acoustic signals from a particular direction or range of directions.

The first array processor 506 is a beam former that works to maximize acoustic response of the set of microphones 502 in the direction of the user's mouth (e.g., directed to the front of and slightly below an earcup), and provides a primary signal 510. Because of the beam forming array processor 506, the primary signal 510 includes a higher signal energy due to the user's voice than any of the individual microphone signals 504.

The second array processor 508 steers a null toward the user's mouth and provides a reference signal 512. The reference signal 512 includes minimal, if any, signal energy due to the user's voice because of the null directed at the user's mouth. Accordingly, the reference signal 512 is composed substantially of components due to background noise and acoustic sources not due to the user's voice, i.e., the reference signal 512 is a signal correlated to the acoustic environment without the user's voice.

In certain examples, the array processor 506 is a super-directive near-field beam former that enhances acoustic response in the direction of the user's mouth, and the array processor 508 is a delay-and-sum algorithm that steers a null, i.e., reduces acoustic response, in the direction of the user's mouth.

The primary signal 510 includes a user's voice component and includes a noise component (e.g., background, other talkers, etc.) while the reference signal 512 includes substantially only a noise component. If the reference signal 512 were nearly identical to the noise component of the primary signal 510, the noise component of the primary signal 510 could be removed by simply subtracting the reference signal 512 from the primary signal 510. In practice, however, the noise component of the primary signal 510 and the reference signal 512 are not identical. Instead, the reference signal 512 may be correlated to the noise component of the primary signal 510, and in such cases, adaptive filtration may be used to remove at least some of the noise component from the primary signal 510, by using the reference signal 512 that is correlated to the noise component.

The primary signal 510 and the reference signal 512 are provided to, and are received by, an adaptive filter 514 that seeks to remove from the primary signal 510 components not associated with the user's voice. Specifically, the adaptive filter 514 seeks to remove components that correlate to the reference signal 512. Adaptive filters can be designed to remove components correlated to a reference signal. For example, certain examples include a normalized least mean square (NLMS) adaptive filter, or a recursive least squares (RLS) adaptive filter. The output of the adaptive filter 514 is a voice estimate signal 516, which represents an approximation of a user's voice signal.

Example adaptive filters 514 may include various types incorporating various adaptive techniques, e.g., NLMS, RLS etc. An adaptive filter generally includes a digital filter that receives a reference signal correlated to an unwanted component of a primary signal. The digital filter attempts to generate from the reference signal an estimate of the unwanted component in the primary signal. The unwanted component of the primary signal is, by definition, a noise component. The digital filter's estimate of the noise component is a noise estimate. If the digital filter generates a good noise estimate, the noise component may be effectively removed from the primary signal by simply subtracting the noise estimate. On the other hand, if the digital filter is not generating a good estimate of the noise component, such a subtraction may be ineffective or may degrade the primary signal, e.g., increase the noise. Accordingly, an adaptive algorithm operates in parallel to the digital filter and makes adjustments to the digital filter in the form of, e.g., changing weights or filter coefficients. In certain examples, the adaptive algorithm may monitor the primary signal when it is known to have only a noise component, i.e., when the user is not talking, and adapt the digital filter to generate a noise estimate that matches the primary signal, which at that moment includes only the noise component.

The adaptive algorithm may know when the user is not talking by various means. In at least one example, the system enforces a pause or a quiet period after triggering speech enhancement. For example, the user may be required to press a button or speak a wake-up command and then pause until the system indicates to the user that it is ready. During the required pause the adaptive algorithm monitors the primary signal, which does not include any user speech, and adapts the filter to the background noise. Thereafter when the user speaks the digital filter generates a good noise estimate, which is subtracted from the primary signal to generate the voice estimate, for example, the voice estimate signal 516.

In some examples an adaptive algorithm may substantially continuously update the digital filter and may freeze the filter coefficients, e.g., pause adaptation, when it is detected that the user is talking. Alternately, an adaptive algorithm may be disabled until speech enhancement is required, and then only updates the filter coefficients when it is detected that the user is not talking. Some examples of systems that detect whether the user is talking are described in co-pending U.S. patent application Ser. No. 15/463,259, titled SYSTEMS AND METHODS OF DETECTING SPEECH ACTIVITY OF HEADPHONE USER, filed on Mar. 20, 2017, and hereby incorporated by reference in its entirety.

In certain examples, the weights and/or coefficients applied by the adaptive filter may be established or updated by a parallel or background process. For example, an additional adaptive filter may operate in parallel to the adaptive filter 514 and continuously update its coefficients in the background, i.e., not affecting the active signal processing shown in the example system 500 of FIG. 5, until such time as the additional adaptive filter provides a better voice estimate signal. The additional adaptive filter may be referred to as a background or parallel adaptive filter, and when the parallel adaptive filter provides a better voice estimate, the weights and/or coefficients used in the parallel adaptive filter may be copied over to the active adaptive filter, e.g., the adaptive filter 514.

In certain examples, a reference signal such as the reference signal 512 may be derived by other methods or by other components than those discussed above. For example, the reference signal may be derived from one or more separate microphones with reduced responsiveness to the user's voice, such as a rear-facing microphone. Alternately the reference signal may be derived from the set of microphones 502 using beam forming techniques to direct a broad beam away from the user's mouth, or may be combined without array or beam forming techniques to be responsive to the acoustic environment generally without regard for user voice components included therein.

The example system 500 may be advantageously applied to an acoustic device, e.g., the headphones 100, to pick-up a user's voice in a manner that enhances the user's voice and reduces background noise. For example, signals from the multipurpose microphone 402 and the dedicated communications microphone 418 (FIG. 4) may be processed by the example system 500 to provide a voice estimate signal 516 having a voice component enhanced with respect to background noise, the voice component representing speech from the user, i.e., the wearer of the headphones 100. As discussed above, in certain examples, the array processor 506 is a super-directive near-field beam former that enhances acoustic response in the direction of the user's mouth, and the array processor 508 is a delay-and-sum algorithm that steers a null, i.e., reduces acoustic response, in the direction of the user's mouth. The example system 500 illustrates a system and method for monaural speech enhancement from one array of microphones 502. In some cases, variations to the system 500 can include, at least, binaural processing of two arrays of microphones (e.g., right and left arrays), further speech enhancement by spectral processing, and separate processing of signals by sub-bands.

Figure 6:
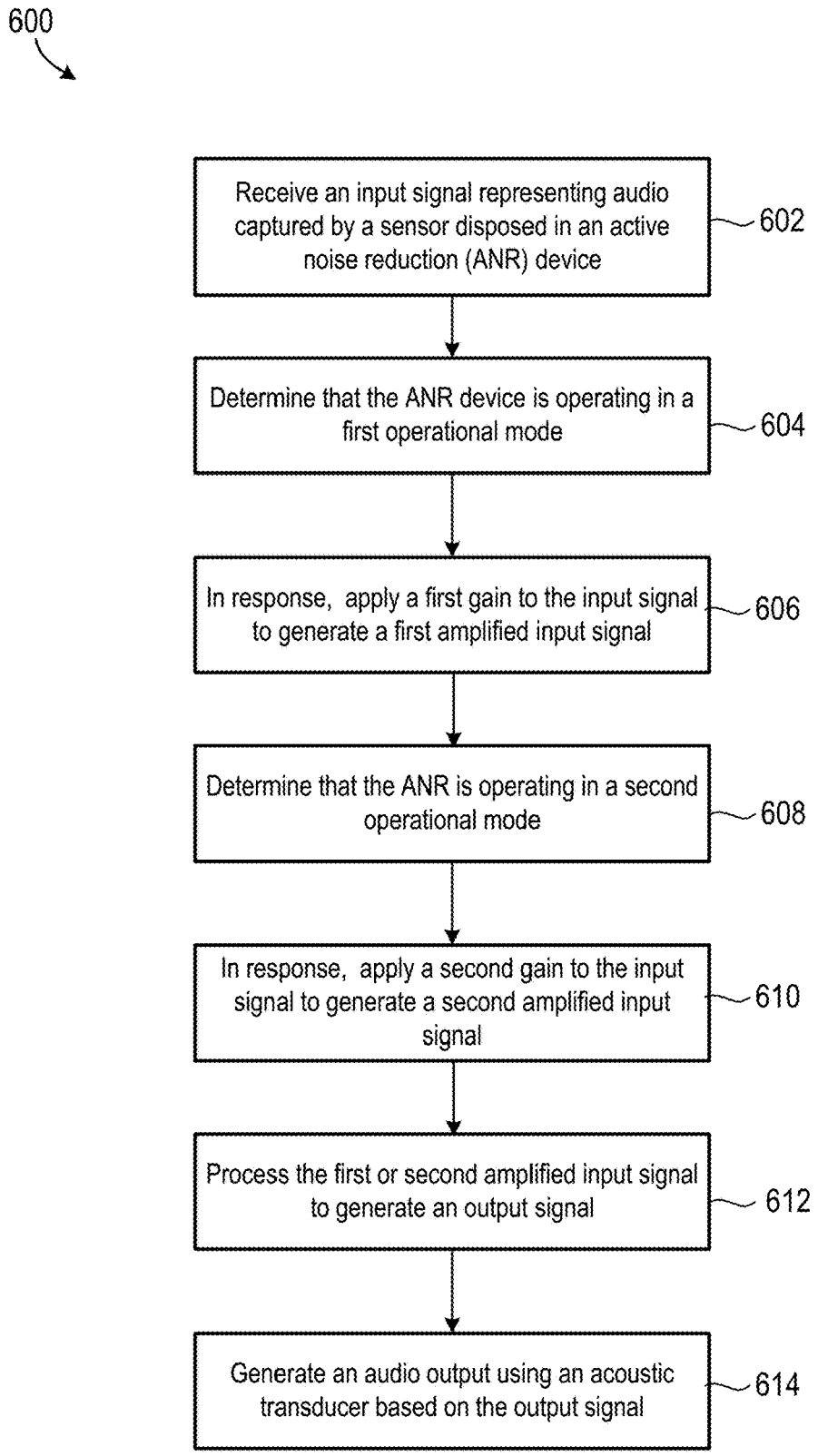
FIG. 6 is a flowchart of an example process for processing signals received from a multipurpose microphone.

FIG. 6 is a flowchart of an example process 600 for processing signals received from a multipurpose microphone. At least a portion of the process 600 can be implemented using one or more processing devices such as the one or more DSPs 308 described with reference to FIG. 3, and/or the processing chips 428, 430 described with reference to FIG. 4. Operations of the process 600 include receiving an input signal representing audio captured by a sensor disposed in an ANR device (602). In some implementations, the ANR device can correspond to the headphones 100 described in relation to FIGS. 1 and 2. In some implementations, the sensors disposed in the ANR device can correspond to microphones disposed in the headphones 100, such as front microphones 202 and/or rear microphone 206. In some implementations, the sensors may also correspond to dedicated feedback microphones (e.g., feedback microphone 414), dedicated feedforward microphones (e.g., feedforward microphone 416), dedicated communications microphones (e.g., communications microphone 418), and/or multipurpose microphones (e.g., multipurpose microphones 302, 402).

Operations of the process 600 further include determining that the ANR device is operating in a first operational mode (604). For example, the first operational mode can include a voice communications mode (also referred to as a communications mode) such as one in which the ANR device is used for phone call. Operations of the process 600 also include applying a first gain to the input signal to generate a first amplified input signal (606) in response to determining that the ANR device is operating in the first operational mode. In some implementations, the first gain can be applied by one or more amplifiers such as amplifiers 304, 420, 404, and 422 described in relation to FIGS. 3 and 4. In some implementations, the first gain can be applied, at least partially, by DSPs such as DSPs 308 and/or communications DSP 410. In some implementations, one or more other attributes of the input signal can be applied or adjusted, possibly in addition to the first gain, in response to determining that the ANR device is operating in the first operational mode.

Operations of the process 600 further include determining that the ANR device is operating in a second operational mode (608) that is different from the first operational mode. For example, the second operational mode can include a noise reduction mode such as one in which the ANR device is used for reducing effects of ambient noise. Operations of the process 600 also include applying a second gain to the input signal to generate a second amplified input signal (610) in response to determining that the ANR device is operating in the second operational mode. In some implementations, the second gain can be applied by one or more amplifiers such as amplifiers 304, 420, 404, and 422 described in relation to FIGS. 3 and 4. In some implementations, the second gain can be applied, at least partially, by DSPs such as DSPs 308 and/or communications DSP 410. In some implementations, one or more other attributes of the input signal can be applied or adjusted, possibly in addition to the second gain, in response to determining that the ANR device is operating in the second operational mode. In some implementations, a lower gain is applied to the input signal in a noise reduction mode of the ANR device than in a voice communications mode of the ANR device.

Operations of the process 600 further include processing the first or second amplified input signal to generate an output signal (612). In some implementations, processing the first or second amplified input signal can include receiving a second input signal representing audio captured by a second sensor disposed in the ANR device, combining the amplified input signal and the second input signal to produce a combined input signal, and processing the combined input signal using at least one compensator to generate the output signal for the ANR device. For example, the amplified input signal can correspond to an amplified signal produced by the multipurpose microphone 402, and the second input signal can correspond to the dedicated feedforward microphone 416. In some implementations, processing the first or second amplified input signal can include processing the corresponding amplified input signal with one or more ANR compensators (e.g., compensators 408). In some implementations, processing the first or second amplified input signal can include processing the device with a communications DSP 410. In some implementations, processing the first or second amplified input signal can include performing a beamforming process. In some implementations, the beamforming process can include receiving a second input signal representing audio captured by a second sensor disposed in the ANR device; processing the first or second amplified input signal and the second input signal to steer a beam toward the mouth of a user of the ANR device to generate a primary signal, processing the corresponding amplified input signal and the second input signal to steer a null toward the mouth of the user of the ANR device to generate a reference signal, and processing the primary signal using the reference signal as a noise reference to generate the output signal for the ANR device. For example, in this case, the amplified input signal can correspond to an amplified signal produced by the multipurpose microphone 402, and the second input signal input can correspond to a signal produced by the dedicated communications microphone 418. In some implementations, the output signal for the ANR device can be an anti-noise signal, a voice signal that approximates the voice of a user of the ANR device, and/or a combination of both. In some implementations, the output signal includes a drive signal for a transducer of the ANR device (e.g., transducer 424).

Figure 7:
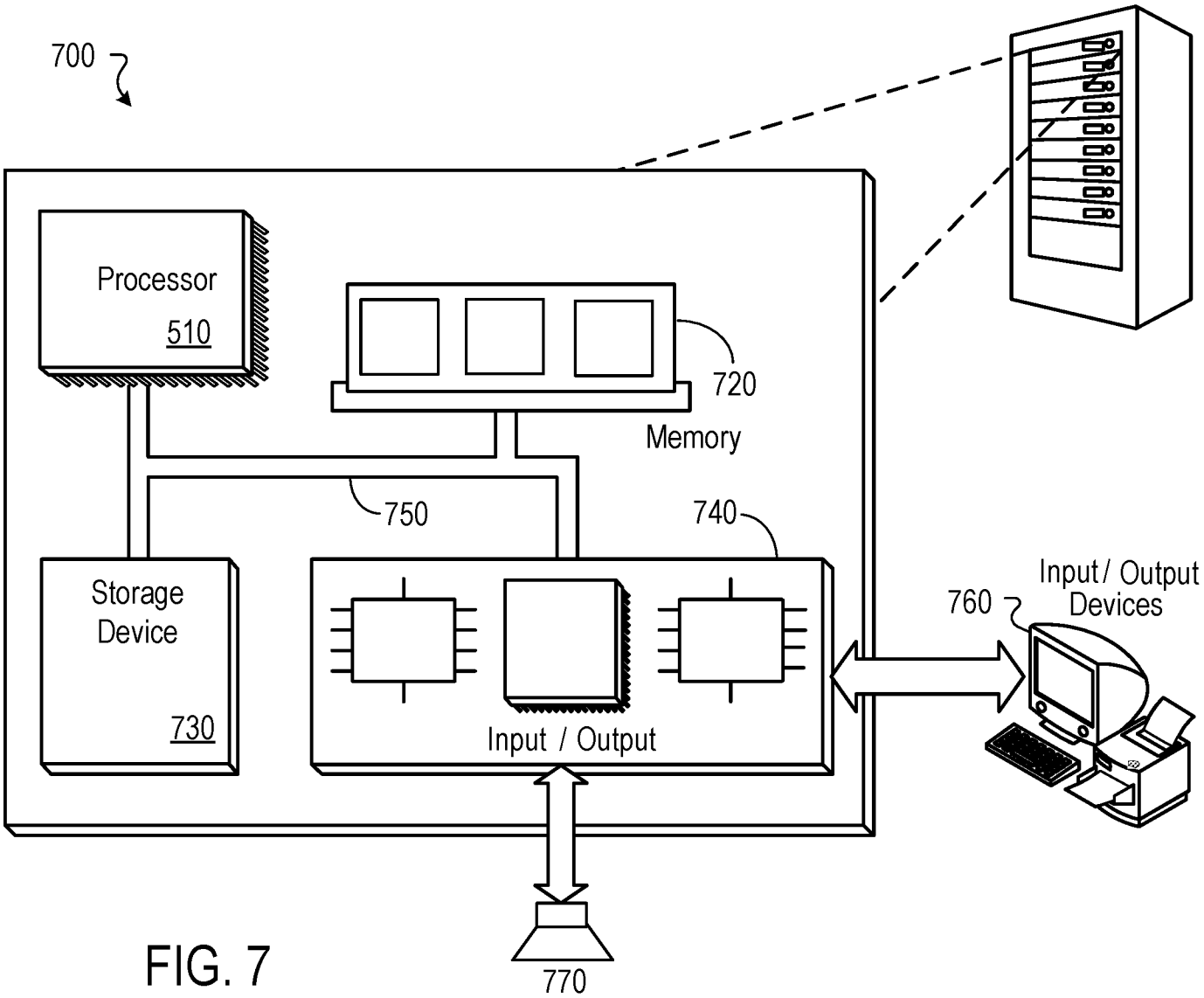
FIG. 7 is a block diagram of an example of a computing device.

FIG. 7 is block diagram of an example computer system 700 that can be used to perform operations described above. For example, any of the systems 100, 300, 400, and 500, as described above with reference to FIGS. 1, 3, 4, and 5, respectively, can be implemented using at least portions of the computer system 700. The system 700 includes a processor 710, a memory 720, a storage device 730, and an input/output device 740. Each of the components 710, 720, 730, and 740 can be interconnected, for example, using a system bus 750. The processor 710 is capable of processing instructions for execution within the system 700. In one implementation, the processor 710 is a single-threaded processor. In another implementation, the processor 710 is a multi-threaded processor. The processor 710 is capable of processing instructions stored in the memory 720 or on the storage device 730.

The memory 720 stores information within the system 700. In one implementation, the memory 720 is a computer-readable medium. In one implementation, the memory 720 is a volatile memory unit. In another implementation, the memory 720 is a non-volatile memory unit.

The storage device 730 is capable of providing mass storage for the system 700. In one implementation, the storage device 730 is a computer-readable medium. In various different implementations, the storage device 730 can include, for example, a hard disk device, an optical disk device, a storage device that is shared over a network by multiple computing devices (e.g., a cloud storage device), or some other large capacity storage device.

The input/output device 740 provides input/output operations for the system 700. In one implementation, the input/output device 740 can include one or more network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 760, and acoustic transducers/speakers 770.

Although an example processing system has been described in FIG. 7, implementations of the subject matter and the functional operations described in this specification can be implemented in other types of digital electronic circuitry, or in computer software, firmware, or hardware, including the structures disclosed in this specification and their structural equivalents, or in combinations of one or more of them. This specification uses the term "configured" in connection with systems and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. The computer storage medium can be a machine-readable storage device, a machine-readable storage substrate, a random or serial access memory device, or a combination of one or more of them. Alternatively or in addition, the program instructions can be encoded on an artificially generated propagated signal, e.g., a machine-generated electrical, optical, or electromagnetic signal, which is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, an app, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by special purpose logic circuitry, e.g., an FPGA or an ASIC, or by a combination of special purpose logic circuitry and one or more programmed computers.

To provide for interaction with a user, embodiments of the subject matter described in this specification can be implemented on a computer having a display device, e.g., a light emitting diode (LED) or liquid crystal display (LCD) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser. Also, a computer can interact with a user by sending text messages or other forms of message to a personal device, e.g., a smartphone that is running a messaging application, and receiving responsive messages from the user in return.

Embodiments of the subject matter described in this specification can be implemented in a computing system that includes a back end component, e.g., as a data server, or that includes a middleware component, e.g., an application server, or that includes a front end component, e.g., a client computer having a graphical user interface, a web browser, or an app through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HTML page, to a user device, e.g., for purposes of displaying data to and receiving user input from a user interacting with the device, which acts as a client. Data generated at the user device, e.g., a result of the user interaction, can be received at the server from the device.

Other embodiments and applications not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A method comprising:

receiving an input signal representing audio captured by a sensor disposed in an active noise reduction (ANR) device;

determining, by one or more processing devices, that the ANR device is operating in a first operational mode;

responsive to determining that the ANR device is operating in the first operational mode, applying a first gain to the input signal to generate a first amplified input signal and providing the first amplified input signal to a first processor corresponding to the first operational mode;

determining, by the one or more processing devices, that the ANR device is operating in a second operational mode different from the first operational mode;

responsive to determining that the ANR device is operating in the second operational mode, applying a second gain to the input signal to generate a second amplified input signal, wherein the second gain is different from the first gain, and providing the second amplified input signal to a second processor, separate from the first processor, corresponding to the second operational mode;

processing the first or second amplified input signal to generate an output signal; and generating, by an acoustic transducer, an audio output based on the output signal.

2. The method of claim 1, wherein the first operational mode of the ANR device comprises a voice communications mode.

3. The method of claim 1, wherein the second operational mode of the ANR device comprises a noise reduction mode.

4. The method of claim 1, wherein the sensor comprises a microphone of the ANR device.

5. The method of claim 1, wherein the output signal comprises a drive signal for the acoustic transducer.

6. The method of claim 5, comprising:

processing the first or second amplified input signal using at least one compensator to generate the drive signal for the acoustic transducer, the drive signal including an anti-noise signal.

7. The method of claim 1, comprising:

receiving a second input signal representing audio captured by a second sensor disposed in the ANR device;

combining the first or second amplified input signal and the second input signal to produce a combined input signal; and processing the combined input signal using at least one compensator to generate the output signal for the ANR device, the output signal including an anti-noise signal.

8. The method of claim 1, comprising:

receiving a second input signal representing audio captured by a second sensor disposed in the ANR device;

processing the first or second amplified input signal and the second input signal to steer a beam toward the mouth of a user of the ANR device to generate a primary signal;

processing the corresponding amplified input signal and the second input signal to steer a null toward the mouth of the user of the ANR device to generate a reference signal; and processing the primary signal using the reference signal as a noise reference to generate the output signal for the ANR device.

9. The method of claim 8, wherein the beam or null is steered using one of: a near field beamforming technique or a delay-and-sum beamforming technique.

10. The method of claim 1, comprising, responsive to determining that the ANR device is operating in the second operational mode, decoupling the first amplified input signal from the first processor.

11. An active noise reduction (ANR) device comprising:

one or more sensors for capturing audio;

at least one amplifier that amplifies an input signal representative of the audio captured by the one or more sensors;

a controller comprising one or more processing devices, wherein the controller is configured to:

determine that the ANR device is operating in a first operational mode, responsive to determining that the ANR device is operating in the first operational mode, apply a first gain to the input signal to generate a first amplified input signal and provide the first amplified input signal to a first processor corresponding to the first operational mode, determine that the ANR device is operating in a second operational mode different from the first operational mode, responsive to determining that the ANR device is operating in the second operational mode, apply a second gain to the input signal to generate a second amplified input signal, wherein the second gain is different from the first gain, and provide the second amplified input signal to a second processor, separate from the first processor, corresponding to the second operational mode, and process the first or second amplified input signal to generate an output signal; and an acoustic transducer for generating an audio output based on the output signal.

12. The device of claim 11, wherein the first operational mode of the ANR device comprises a voice communications mode.

13. The device of claim 11, wherein the second operational mode of the ANR device comprises a noise reduction mode.

14. The device of claim 11, wherein the sensor comprises a microphone of the ANR device.

15. The device of claim 11, wherein the output signal comprises a drive signal for the acoustic transducer.

16. The device of claim 15, wherein the controller comprises at least one compensator that processes the first or second amplified input signal to generate the drive signal for the acoustic transducer, the drive signal including an anti-noise signal.

17. The device of claim 11, wherein the controller is configured to:

receive a second input signal representing audio captured by a second sensor disposed in the ANR device;

combine the first or second amplified input signal and the second input signal to produce a combined input signal; and process the combined input signal using at least one compensator to generate the output signal for the ANR device, the output signal including an anti-noise signal.

18. The device of claim 11, wherein the controller is configured to:

receive a second input signal representing audio captured by a second sensor disposed in the ANR device;

process the first or second amplified input signal and the second input signal to steer a beam toward the mouth of a user of the ANR device to generate a primary signal;

process the corresponding amplified input signal and the second input signal to steer a null toward the mouth of the user of the ANR device to generate a reference signal; and process the primary signal using the reference signal as a noise reference to generate the output signal for the ANR device.

19. The device of claim 18, wherein the beam or null is steered using one of: a near field beamforming technique or a delay-and-sum beamforming technique.

20. The device of claim 11, wherein the controller configured to, responsive to determining that the ANR device is operating in the second operational mode, decouple the first amplified input signal from the first processor.

21. One or more non-transitory machine-readable storage devices storing machine-readable instructions that cause one or more processing devices to execute operations comprising:

receiving an input signal representing audio captured by a sensor disposed in an active noise reduction (ANR) device;

determining that the ANR device is operating in a first operational mode;

responsive to determining that the ANR device is operating in the first operational mode, applying a first gain to the input signal to generate a first amplified input signal and providing the first amplified input signal to a first processor corresponding to the first operational mode;

determining that the ANR device is operating in a second operational mode different from the first operational mode;

responsive to determining that the ANR device is operating in the second operational mode, applying a second gain to the input signal to generate a second amplified input signal, wherein the second gain is different from the first gain, and providing the second amplified input signal to a second processor, separate from the first processor, corresponding to the second operational mode;

processing the first or second amplified input signal to generate an output signal; and causing an acoustic transducer to generate an audio output based on the output signal.

22. The one or more non-transitory machine-readable storage devices of claim 21, wherein the first operational mode of the ANR device comprises a voice communications mode, and wherein the second operational mode of the ANR device comprises a noise reduction mode.

* * * * *